United States Patent [19]

Havre

[11] 4,321,720

[45] Mar. 30, 1982

[54] METHOD OF TRANSFERRING A FLUID FROM A STATION ON THE SEA BED TO A VESSEL, OR VICE-VERSA, AND A MEANS AND A VESSEL FOR CARRYING OUT THE METHOD

[76] Inventor: Odd Havre, Stasjonsveien 51/53, Oslo 3, Norway

[21] Appl. No.: 3,520

[22] Filed: Jan. 15, 1979

[30] Foreign Application Priority Data

Jan. 17, 1978 [NO] Norway ..... 780164

[51] Int. Cl.[3] ..... B63B 21/52; B63B 51/02

[52] U.S. Cl. ..... 441/5; 114/257; 114/230; 114/125; 114/144 B; 141/113; 405/188; 441/21

[58] Field of Search ..... 9/8 P, 8 R; 405/210, 405/188; 114/144 B, 125, 230, 293, 256, 257, 321; 141/113, 279, 284, 387, 388

[56] References Cited

U.S. PATENT DOCUMENTS

| | | | |
|---|---|---|---|
| 3,010,214 | 11/1961 | Postlewaite | 114/144 B |
| 3,487,486 | 1/1970 | Leonard | 114/333 |
| 3,583,445 | 6/1971 | Harbonn | 114/257 |
| 3,605,668 | 9/1971 | Morgan | 114/293 |
| 3,881,530 | 5/1975 | Faldi | 141/284 |
| 3,921,684 | 11/1975 | Allen | 141/279 |
| 4,086,865 | 5/1978 | Statham | 114/257 |
| 4,173,804 | 11/1979 | Duc | 114/230 |

FOREIGN PATENT DOCUMENTS

| | | |
|---|---|---|
| 2505721 | 1/1976 | Fed. Rep. of Germany . |
| 2610812 | 9/1977 | Fed. Rep. of Germany . |
| 1177926 | 1/1970 | United Kingdom . |

*Primary Examiner*—Trygve M. Blix
*Assistant Examiner*—D. W. Keen
*Attorney, Agent, or Firm*—Finnegan, Henderson, Farabow, Garrett & Dunner

[57] ABSTRACT

In order to transfer a fluid from a station on the sea bed for a vessel or vice versa, a discharging/loading buoy comprising coupling apparatus for fluid flow is placed in a submerged state and fixed in this state with anchoring apparatus. A vessel is brought and held in position above the buoy by means of dynamic positioning. Then the coupling apparatus for the fluid flow is connected to a coupling section on the vessel.

7 Claims, 3 Drawing Figures

Figure 1:
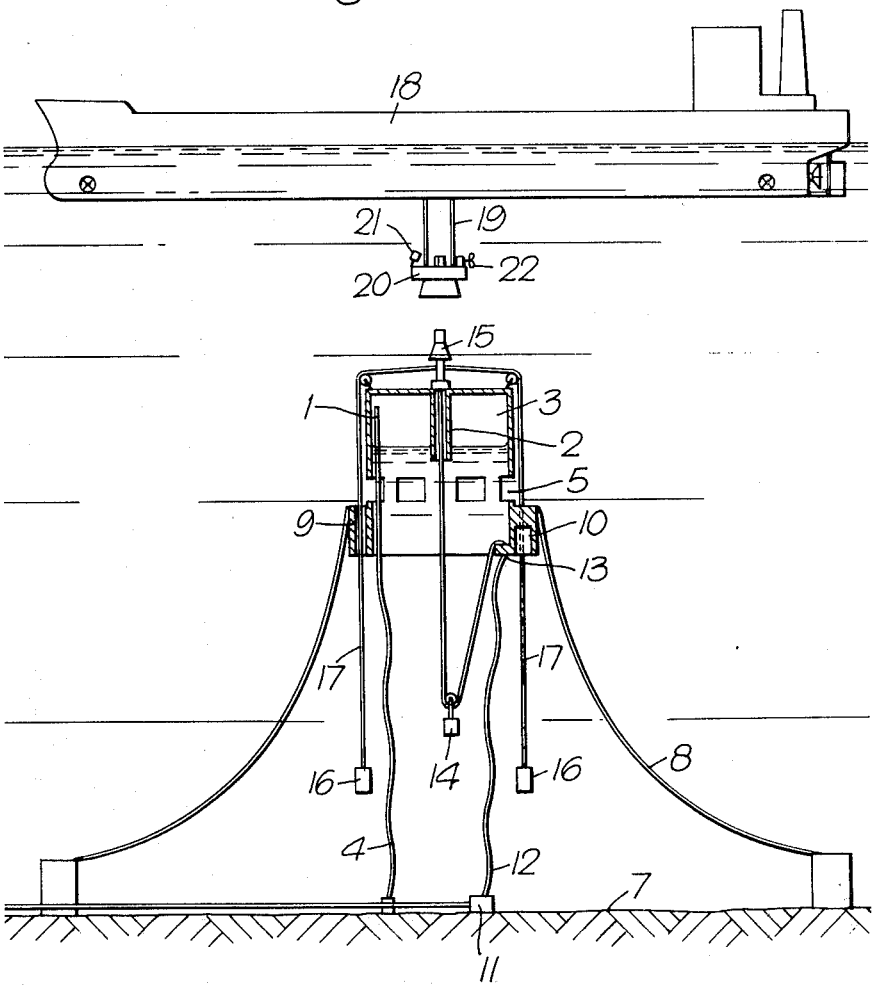

METHOD OF TRANSFERRING A FLUID FROM A STATION ON THE SEA BED TO A VESSEL, OR VICE-VERSA, AND A MEANS AND A VESSEL FOR CARRYING OUT THE METHOD

The present invention relates to a method of transferring a fluid from a station on the sea bed to a vessel, or vice-versa, in which a discharging/loading buoy, in a submerged state and anchored to the sea bed, carries a flow coupling means for coupling to the vessel and has means for regulating its submersion.

The invention pertains also to a buoy for carrying out the method, and to a vessel with dynamic positioning means for carrying out the method and for cooperation with the buoy.

The loading systems presently in use or planned for use in the offshore loading of fluids in deep waters are based on mooring the vessel to a buoy and leading the cargo hose on board from the buoy. To permit the vessel to turn freely in accordance with shifting winds and seas, the mooring and loading arrangement is most often located at the forecastle of the vessel.

Because the acceptable loads on the mooring system are limited, and because the operation is strongly dependent on the ship's movements, the loading operation and its degree of utilization will at all times be strongly dependent on the weather conditions. The working operations are also rendered more difficult because they are usually carried out on or near the surface of the sea, where the largest movements occur.

To permit the performance of working operations as much as possible even under unfavourable weather conditions, and thus to increase the degree of utilization, the buoys used have gradually become larger and more complicated, which in turn has entailed an increased investment of funds and high operating costs.

Owing to the fact that the buoys are located on the surface of the sea, there is also a risk of collision between the vessel and buoy during the mooring and loading operation.

An important disadvantage of the existing methods is the degree to which they are limited by weather conditions in establishing connection and maintaining it for the period of time required to complete the loading operation (about 20 hours).

In the existing systems planned for use in the exposed regions of the North Sea, it is generally assumed that it will be possible to establish connection at significant wave heights of up to 12 feet and to maintain the connection up to significant wave heights of 18 feet. These are the wave heights that will exist at a wind strength of Beaufort 6, strong wind. Under the prevailing weather conditions on the Norwegian continental shelf, however, these limits will be exceeded a substantial part of the time, and in the winter season, most of the time.

This factor, together with the fact that the storage capacity on the production platforms is limited, often to only 3–4 days' production, means that in periods of bad weather production will have to be reduced and in the worst case, stopped.

The limitations discussed above arise owing to the difficulties connected with establishing connection, fishing up a mooring-loading arrangement floating on the surface as the seas become heavier. These problems are amplified because the "fishing" operation occurs from the bow of the ship.

In addition, during the establishment phase the vessel must maneouver crosswise to the wind and sea direction at reduced speed and closely adjacent to the loading buoy and production platform. This job becomes increasingly difficult as weather and sea conditions worsen.

In addition to this come the forces on the mooring connection between the ship and buoy. In addition to weather-induced forces, this connection must also be able to withstand the forces caused by resonance problems in the oscillating system which the ship and buoy comprise.

It is known that wave movements decrease exponentially with increasing depth. This means that wave movements will be significantly reduced at a relatively small change in depth.

In accordance with the invention a method is developed for transferring a fluid from a station on the sea bed to a vessel, or vice-versa, in which a discharging-/loading buoy, in a submerged state and anchored to the sea bed, carries a flow coupling means for coupling to the vessel and has means for regulating its submersion, the method being characterized in that the vessel is brought to a position above the buoy and held there by means of dynamic positioning, and thereafter the said flow coupling means is connected to a coupling section on the vessel.

At a depth of about 50 meters, the wave movements under most weather conditions will be reduced to such an extent that one no longer has to take them into account. Considering the movement of the ship, it would be preferable to position the point of connection as close to midships as possible. A system based on dynamic positioning of the vessel above a submerged buoy, therefore, should offer substantial advantages both in facilitating connection and in lessening the effects of movement. The dynamic positioning systems on the market today operate with a positioning accuracy of less than 5% of the depth.

Because the buoy is submerged, there will be no risk of collision between the buoy and ship. This will also facilitate maneouvering toward and away from the loading/discharging position, and thus reduce the dead time associated with coupling and uncoupling. The next vessel will also be enabled to come into position more rapidly.

A submerged buoy can be made considerably simpler than a surface buoy, without affecting its operational reliability. The submerged buoy will not be exposed to the same wind, sea and weather conditions as a surface buoy. Moreover, it will not be subjected to mooring forces, and equipment for handling hoses and moorings will be unnecessary.

Advantageously the said method is carried out in that the said flow coupling means is gripped by a grab head lowered from the vessel and by retraction of the grab head is raised up and connected to a coupling section on the vessel. According to the invention an advantageously modification is characterized in that a flow connection means is lowered from the vessel and connected to the flow coupling means at the buoy.

A single-point mooring system for the loading/discharging of fluids to/from a vessel is disclosed in British Pat. No. 1.177.926. It is suggested, inter alia, that the vessel be anchored to an underwater buoy. The loading-/discharging hose is brought up from the underwater buoy, being fished up from a submerged position, through the utilization of marking buoys and retriever cables. A disadvantage of this known system is that the vessel is anchored to the buoy, and that the retrieval of the hose is time-consuming and can only be performed under favourable weather conditions. The system is sensitive to weather and wind forces because one must take into account the mutual relationship between the mooring arrangement and the loading/unloading arrangement.

It is known from German Pat. Pub. No. 2.505.721 to utilize a fixed underwater station in which a sufficient length of hose is stored. A vessel is held in position above the underwater station through the utilization of dynamic positioning, and the hose is fished up from the underwater station by means of a grab head which is guided down from the central bottom portion of the vessel. A disadvantage of this known system is that a fixed underwater station is utilized. This means that the cargo hose must be fished up from a substantial depth, there being no way to reduce the distance between the underwater station and the vessel, as is the case if one utilizes a submerged buoy, anchored to the sea floor, with means for regulating its degree of submersion. In addition, this specification does not describe any connection techniques.

From German Pat. Pub. No. 2.610.812, it is known to utilize a submerged buoy that is anchored to the sea bed. A hose connection is established from the buoy to a vessel in that the hose is fished up by the vessel. The vessel is anchored to a surface buoy which is connected by means of one or several cables to the submerged buoy. The submerged hose is fished up in the conventional way, utilizing surface marking buoys and retrieval equipment from the vessel. The end of the hose that is adapted for connection to the vessel is held on the surface by means of a buoy. A disadvantage of this system is that the vessel is anchored to a buoy, and that fishing up the hose involves the known difficulties.

During loading/discharging, one must at all times take into account the fact that the vessel is anchored to a buoy, in order to ensure that the mooring cables and the loading/discharging hose do not come into conflict.

Compared to the state of the art as exemplified by the above specifications, the invention has the advantage that one utilizes the dynamic positioning capabilities of the ship, thus avoiding the use of mooring cables. The submerged buoy ensures that the vessel and buoy will not come into conflict with one another. The depth of the buoy can be regulated as necessary, both during connection and disconnection and during the loading-/discharging operation.

A buoy for carrying out the method according to the invention is characterized by a flow coupling means which is fixed horizontally on the buoy.

An important modification of the buoy is characterized in that the necessary length of flow connecting means is stored at the buoy and adapted to be drawn out therefrom. This means that one has a fixed coupling point, the depth of which can be regulated as necessary, and that one has almost unlimited room for storing the necessary length of flow means in the sea.

Preferably, a flow connecting hose is disposed in a vertical channel in the buoy, with the coupling portion arranged on the top side of the buoy. Preferably, a section of the connecting hose hangs in one or more loops beneath the buoy.

The invention pertains also to a vessel with dynamic positioning means to carry out the method and to cooperate with the buoy, and that which characterizes the vessel is that it includes a hoist for a grab head, which is adapted to be guided down to the flow coupling means at the buoy, to grasp it, and by means of the hoist pull the coupling means up to the vessel.

The invention will be further elucidated with reference to the accompanying drawing, which shows in principle the way in which the system can be built up and utilized.

Figure 2:
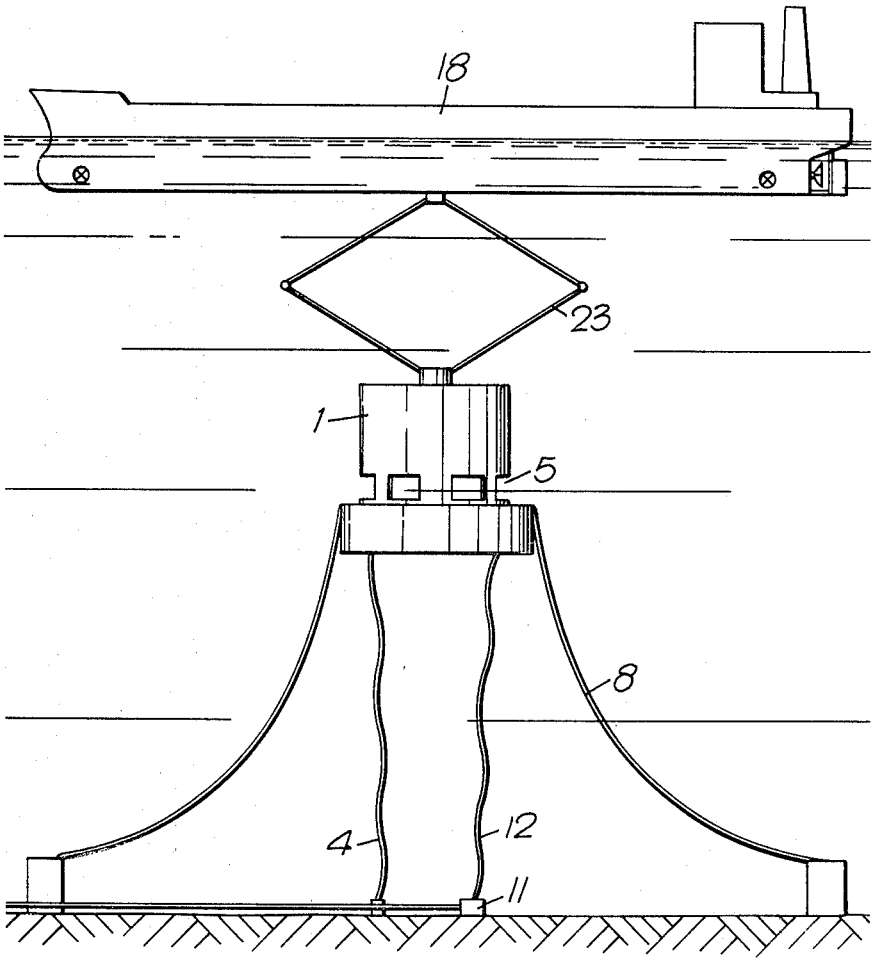

FIG. 1 discloses an embodiment wherein a flexible connecting hose is used, the buoy being shown in section, and FIG. 2 discloses a second embodiment wherein an articulated flow connecting means is used.

Figure 3:
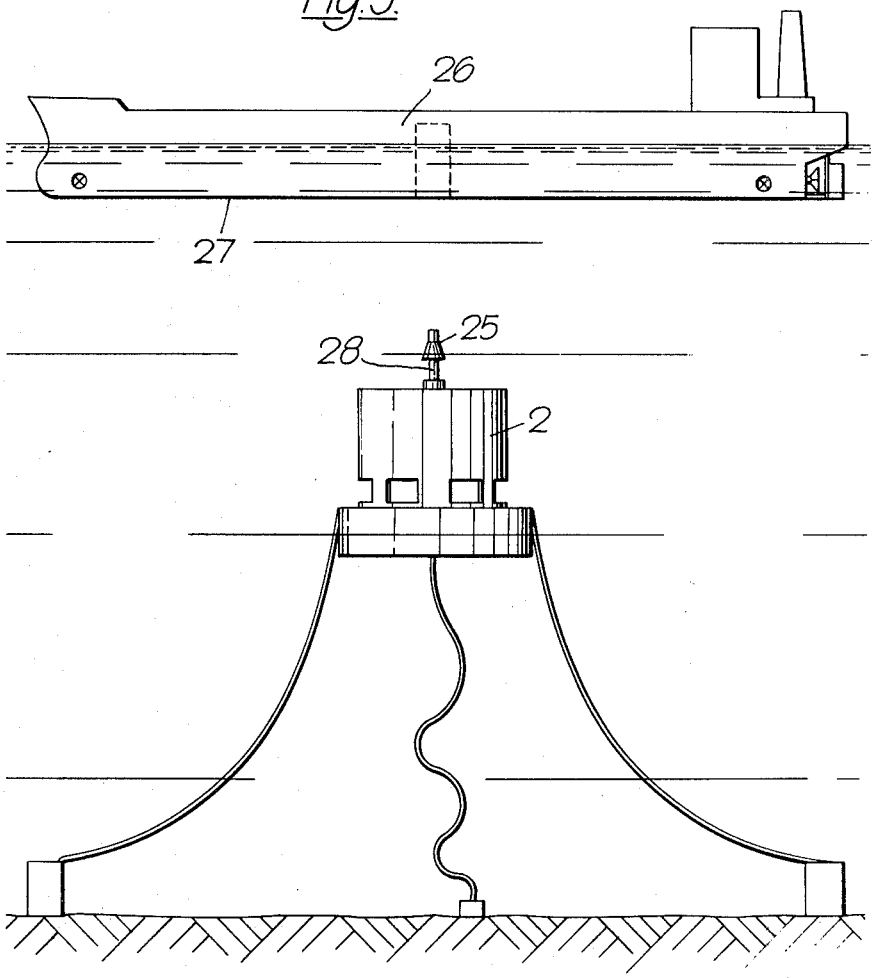

FIG. 3 discloses a third embodiment wherein the buoy is adapted to be raised up under the vessels bottom.

In FIG. 1 a bell-shaped buoy 1 is held at the desired depth by means of a variable volume 3 which is filled with a liquid or a gas having a specific gravity that deviates from that of the surrounding sea water. By varying the volume, the resultant buoyancy can be varied and controlled. In this case, air is used as the buoyancy medium, being supplied through a supply hose 4 which discharges into the upper portion of the air pocket 3. The buoy is provided with openings 5 which restrict the size of the air cushion.

The buoy is anchored to the sea bed 7 by means of cables 8.

To ensure stability, the buoy is provided with ballast 9 at the bottom thereof. The ballast will also counteract heeling caused by the effects of currents. In waters in which the effects of current are expected to be great, it may be necessary to provide special trim chambers 10 with separate control.

The buoy has a central opening in the form of a guide pipe 2.

A flexible loading/discharging hose 12 runs from an underwater station 11 up to the buoy 1. The hose 12 is in this case guided through a fixed point 13 at the lower edge of the buoy and is weighted by a weight 14. The hose 12 then extends up through the central guide pipe 2 to a coupling section 15. The coupling section 15 is weighted by weights 16 suspended from cables 17.

Positioned above the buoy 1 is a vessel 18 which is held in position by means of dynamic positioning. The vessel comprises a hoist 19, in this case represented by two cables from which a grab 20 is a television camera 21 and a positioning unit 22 (motor-driven propeller).

When connection is to occur, the vessel 18 is brought into position above the buoy 1. The depth of the buoy can be regulated as needed. Thus, if weather and wind conditions so permit, the buoy can be forced up closely adjacent to the bottom of the vessel. This would of course facilitate coupling. By means of the hoist 19, the grab 20 is then lowered and coupled to the coupling section 15. The hose 12 is then drawn up by means of the hoist 19, and its connection to the vessel's pipe system occurs on board the vessel.

To disconnect the lines, the coupling section 15 is lowered to the buoy 1 and the grab 20 is released. The lowering of the coupling section is facilitated by the weights 14 and 16, ensuring that the coupling section 15, when disconnected, will always be located in a fixed position on the upper side of the buoy.

As mentioned above, the depth of the buoy can be varied during the coupling and uncoupling operations. The depth of the buoy can of course also be altered in accordance with weather conditions and wave movements, even while cargo transfer is taking place.

The portion of the hose 12 which hangs in the sea below the buoy can hang in one or more loops. The method of weighting the hose and the coupling section illustrated on the drawing is meant to serve only as an example. The weighting can optionally be omitted, if conditions permit. The buoy can also be made in many other ways, known per se. One can also envision embodiments in which the grab head 20 is coupled to a connecting hose on the vessel. This conduit could then be either flexible or telescopic.

The embodiment in FIG. 2 differs mainly from that in FIG. 1 in that an articulated flow connecting means 23 is used. This flow connecting means is known per se as a four-bar linkage loading system.

The articulated flow connecting means 23 is mounted on the buoy 1 and is picked up from the tanker 18 by a hoist means as in FIG. 1.

Various modifications of the invention are possible. One modification is to use one single connecting hose from the bottom station 11 and up through a guide in or at the buoy and further up to the tanker. It is of course also possible to use a telescopic riser connection between the bottom station 11 and the buoy 1, or an articulated flow connecting means as in FIG. 2. It may of course also be possible to use a combination of articulated and telescopic flow means between the tanker and the buoy. Other modifications are also possible.

The embodiment in FIG. 3 differs in that the buoy 24 and its horizontally fixed coupling means 25 is adapted to be raised as a unit up to a position under the tankers' 26 bottom 27. Thus the buoy is coupled "directly" to the tanker.

Preferably a short length of flexible pipe 28 is used in the coupling means. The third method, whereafter the hose or the like is lowered from the tanker and down to the buoy is not disclosed. A person skilled in the art is, however, thought be able to amend the hoist 19, 20 in FIG. 1 so that a hose may be lowered from a storage room in the vessel and down to the buoy by means of the hoist. Other solutions are of course possible, as far as they are within the reach of a person skilled in the art.

Having described my invention, I claim:

1. A method of offshore transferring a fluid from a station on a sea bed to a vessel, and vice-versa, comprising the steps of providing a submerged buoy which is anchored to the sea bed and is movable to selective water depths, providing a flow coupling means on said buoy which is movable therewith and fixed horizontally thereto and in fluid flow connection with said station, providing means on said vessel adapted to be lowered into coupling engagement with said flow coupling means, positioning said vessel above said buoy and maintaining said vessel positioning by dynamic positioning, moving said buoy and coupling means to a water depth where the influence of wind and wave movements thereon is negligible, and lowering said means on said vessel into coupling engagement with said coupling means at said water depth, raising said coupling means to said vessel and, establishing fluid flow connection between said vessel and said station through said coupling means on board said vessel.

2. A method according to claim 1, characterized in that said flow coupling means is gripped by a grab head lowered from the vessel and by retraction of the grab head is raised up and connected to a coupling section on the vessel.

3. A device for use in offshore transferring a fluid from a station on a sea bed to a vessel, and vice-versa, comprising a buoy anchored to the sea bed, said buoy including means operable to vary the water depth of said buoy, a flow coupling means on said buoy movable therewith and fixed horizontally thereto, means for connecting said coupling means in fluid flow connection with said station, said coupling means being movable by movement of said buoy to a water depth where the influence of wind and wave movements are negligible, said vessel including means which can be moved downwardly to said coupling means on said buoy at said water depth and being operable to grasp said coupling means, said grasping means being operable to pull said coupling means upwardly to said vessel, whereby fluid flow connection can be on board said vessel.

4. A device as claimed in claim 3, said grasping means including a grab head and a hoist for guiding said grab head downwardly to said coupling means on said buoy at said water depth.

5. A device according to claim 3, characterized in that a length of said flow connecting means is stored at the buoy and adapted to be drawn out therefrom.

6. A device according to claim 5, characterized in that a section of the connecting means hangs in one or more loops of hose beneath the buoy.

7. A device according to claim 5, wherein the flow connecting means comprises a connecting hose disposed in a vertical channel in the buoy and operable to connect said coupling means and said station, said coupling means being arranged on the upper side of said buoy.

* * * * *